US010077634B2

(12) United States Patent
Perio, Jr.

(10) Patent No.: US 10,077,634 B2
(45) Date of Patent: Sep. 18, 2018

(54) MAGNETIC DEPOSITION PREVENTION SUBASSEMBLY AND METHOD OF USE

(71) Applicant: PIPELINE PROTECTION GLOBAL LLC, San Antonio, TX (US)

(72) Inventor: Dudley J. Perio, Jr., Austin, TX (US)

(73) Assignee: Pipeline Protection Global LLC, San Antonio, TX (US)

( * ) Notice: Subject to any disclaimer, the term of this patent is extended or adjusted under 35 U.S.C. 154(b) by 339 days.

(21) Appl. No.: 14/870,765

(22) Filed: Sep. 30, 2015

(65) Prior Publication Data

US 2017/0051576 A1 Feb. 23, 2017

Related U.S. Application Data

(60) Provisional application No. 62/206,818, filed on Aug. 18, 2015.

(51) Int. Cl.
*E21B 37/00* (2006.01)
*E21B 31/06* (2006.01)

(52) U.S. Cl.
CPC ..... *E21B 37/00* (2013.01); *E21B 31/06* (2013.01)

(58) Field of Classification Search
CPC ..... E21B 31/06; E21B 37/00
See application file for complete search history.

(56) References Cited

U.S. PATENT DOCUMENTS 3,228,878 A 1/1966 Moody
3,637,033 A 1/1972 Mayall
4,422,934 A 12/1983 Debney
4,935,133 A 6/1990 Hirama
5,024,271 A 6/1991 Meihua
5,052,491 A 10/1991 Harms
5,178,757 A 1/1993 Corney
5,453,188 A 9/1995 Florescu
5,700,376 A 12/1997 Carpenter
7,353,873 B2 4/2008 Borst

OTHER PUBLICATIONS

Battelle Columbus Operations, U.S. Department of Energy, "Non-Chemical Technologies for Scale and Hardness Control", Jan. 1998 (29 pages).
Farshad, Fred F. And Vargas, Silvia M., "Scale Prevention, a Magnetic Treatment Approach", Society of Petroleum Engineers, Inc. Paper No. 77850, Oct. 8-10, 2002 (11 pages).
Farshad, Fred F., et al., "The Effects of Magnetic Treatment on Calcium Sulfate Scale Formation", Society of Petroleum Engineers, Inc. Paper No. 76767, May 20-22, 2002 (9 pages).
(Continued)

*Primary Examiner* — Caroline N Butcher
(74) *Attorney, Agent, or Firm* — Clark Hill Strasburger

(57) ABSTRACT

An apparatus and method for controlling and/or minimizing the formation or accumulation of unwanted deposits on the inside of fluid flow paths by employing at various locations along the path an assembly of permanent magnets oriented such that the fluid flow is preferably from the North magnetic pole to the South magnetic pole. The apparatus including an upper portion and a lower portion with a cylindrical magnet disposed on the surface of the upper portion. The lower portion includes a safety shelf to prevent compression of the magnet by the upper portion and the lower portion.

18 Claims, 9 Drawing Sheets

(56) References Cited

OTHER PUBLICATIONS

Form PCT/ISA/210, International Search Report dated Dec. 23, 2015 for International Patent Application No. PCT/US2015/054047, 2 pages.
Form PCT/ISA/237, Written Opinion of the International Searching Authority dated Dec. 23, 2015 for International Patent Application No. PCT/US2015/054047, 7 pages.
Rohm and Haas Company, "Acumer™ 2100 Scale Inhibitor and Dispersant", © 2008 (3 pages).
Tung, Nguyen Phuong, et al., "Studying the Mechanism of Magnetic Field Influence on Paraffin Crude Oil Viscosity and Wax Deposition Reductions", Society of Petroleum Engineers, Inc. Paper No. 68749, Apr. 17-19, 2001 (7 pages).

MAGNETIC DEPOSITION PREVENTION SUBASSEMBLY AND METHOD OF USE

BACKGROUND OF THE DISCLOSURE

1. Field of the Disclosure

This disclosure relates to the field of inhibiting the formation of deposits inhibiting the flow of fluid in conduits and the like and, more specifically, to methods and devices for inhibiting the formation of unwanted deposits in downhole production equipment.

2. Description of the Related Art

The problem of unwanted solid deposition in oil wells, gas wells, surface production equipment, and in hydrocarbon flow lines has presented a challenge to the petroleum industry since the first wells were drilled more than one hundred years ago. Although scale deposition is a major problem that interferes with the production of oil and gas, it is not the only problem. Paraffin or wax deposition has also been recognized as a major problem from the inception of the oil industry all over the world, as has asphaltene formation. The occurrence of these unwanted deposits in hydrocarbon producing conduits and related equipment can result in numerous problems, including reduced production and severe and often costly startup problems following pipeline shut down. Other problems with unwanted deposits can include congealing hydrocarbons, interface problems, depositions in tank bottoms, high line pressures, plugged flow lines, under deposit corrosion, plugging of injection wells and filter plugging.

Scale deposit and accumulation is a significant problem to oil and gas producer wells. The rate at which scale accumulates is dependent upon a variety of factors, including the quantity of minerals transported in the fluid, the temperature variations in the well bore, and pressure variations in the tubing, including variations resulting from tubing interior diameter changes. Once scale crystals begin to precipitate out of the fluid and form on the interior of the production conduit, the growth rate can accelerate. This phenomenon has been described as crystalline growth theory.

Chemical treatment methods for the removal of unwanted deposits such as scale, paraffin, asphaltene and hydrates, include acid treatments or the use of a variety of other chemicals to remove the unwanted deposits. Often, the type of chemical treatment method selected will vary depending upon the type of condensate or deposit. Chemicals, such as polyelectrolytes, phosphonates (such as DETPMP), polyphosphinocarboxylic acids (PPCA), organophosphonic acids (such as diethylenetriamine penta(methylphosphonic acid) and hexamethylenediamine tetramethylene phosphonic acid (HMDP)), and polymers such as polyacrylate (PAA), polyvinyl sulphonate (PVS), sulfonated polyacrylates, phosphomethylated polyamines (PMPA), and the ACUMER™ polymer products, such as ACUMER™ 2100, a carboxylate/sulfonate copolymer commercially available from Rohm and Haas Company (Philadelphia, Pa.) are often used to inhibit or prevent the growth of unwanted hydrocarbon deposits, such as scale crystals, on production tubing interiors. Other chemical-related treatments include the use of bacteria, enzymes, and continuous or batch down hole chemical injection and squeeze treatments of crystal modifiers. Typically, such chemicals are effective towards and limited to only specific types of deposits.

Despite their advantages, chemical treatments are usually expensive, environmentally hazardous in many cases, and are oftentimes very sensitive, working effectively only on specific crudes or on specific types of unwanted deposits.

Chemical treatment often requires dedicated equipment to introduce the chemicals to the deepest sections of the well bore. Traditionally, scale prevention chemicals are injected down the annulus of the production tubing and enter the production tubing through sliding sleeves or other valves. In recent years, small stainless steel lines have been installed into the interior of the production tubing and run to the deepest point in the well bore. Scale prevention chemicals are pumped through the small line under pressure and mixed with the fluids produced from the well. This allows the fluid to be treated during normal production of the well, but requires continuous monitoring of the injection strings to maintain proper operation. Additionally, operation of the well is further complicated because access to the center of the production tubing is blocked, preventing through tubing, such as wire line or coiled tubing. Treatment chemicals are typically not recoverable from the production fluid.

Some deposits are so hard that chemicals are not effective, requiring physical methods for their removal, including mechanical removal. Physical methods have been studied and put to use for the past several decades as an alternative to chemical methods and to prevent and control unwanted deposit formation. Mechanical removal can include the use of drills, mills and other tools to grind or tear the deposits loose from the interior of the production tubing walls. Occasionally, such processes cause damage to the interior of the tubing and can cause worse scale accumulation rates in the future as a result. In worst-case scenarios, the production tubing must be extracted and replaced. Other physical methods which have been described include hot water circulation, steam injection, cutting or wire-lining, and the use of magnetic devices on electromagnets, such as solenoids and yoke-based electromagnets. However, while electromagnets can produce magnetic fields of great intensity, their choice for use in downhole environments is often not practical since electromagnets require an electrical power supply, cooling, and periodic servicing.

In contrast to electromagnetic devices, permanent magnet devices do not require an electrical power supply downhole and require little to no maintenance. Several attempts have been made to use permanent magnet devices to reduce downhole buildup. Examples of several of the attempts include U.S. Pat. No. 3,228,878 which issued to Moody on Jan. 11, 1966 and discloses the use of magnets to provide a magnetic field having two polar zones a short distance from each other. The field may be provided by one or more high strength permanent magnets located outside the flow passageway and each having its poles facing toward the passageway in a direction normal to its path of flow. The magnetically treated liquid may flow with a minimum of turbulence and free it from external magnetic influence for a distance within the flow passageway from 10 to 150 times the length of the magnetic field to avoid too rapid a dissipation of the change effected therein by the passage through the magnetic field.

Another contribution to the art was made by Debney, et al. in U.S. Pat. No. 4,422,934, which proposes a magnetic device for the treatment of calcareous fluids. Described therein is a device for magnetically treating liquids to inhibit the deposit of scale in plumbing systems, appliances, boilers, and the like. The device has an elongate housing with an inlet and an outlet for the flow of liquid there through. A support structure is located inside the housing to retain a plurality of longitudinally spaced-apart magnets. The magnets are held in position by a plurality of transverse holding elements which are positioned so that the magnets are angularly disposed in a helical arrangement. The magnets are directly immersed in the liquid flowing through the device.

As a further example, U.S. Pat. No. 5,178,757 to Mag-Well, Inc. describes a device that includes an elongated hollow core providing at least one passage through which the fluid to be treated flows. An array of magnets extends longitudinally along the core with the poles of the magnets arranged so as to provide a magnetic field perpendicular to the flow path to enhance the magnetic conditioning effect of the tool. An alternative embodiment of the device has three longitudinally extending arrays of magnets with two fluid passages between them. The magnets are formed of a rare earth magnetic material, and are backed by a flux-carrying member of cobalt-iron alloy, with rounded corners so as to reduce loss of a magnetic field. Each magnet is mounted at least partially within an outer surface of the core with the flux-carrying member contacting, covering, and extending between the outer major faces of the magnets.

U.S. Pat. No. 5,052,491 issued to Harms, et al. on Oct. 1, 1991 describes the use of coupling devices that contain magnets to control the accumulation of paraffin and deposits in a downhole oil string or oil transmission flow lines. The coupling devices are made of a nonmagnetic material surrounded by a magnet and shield of magnetic material. The devices are used to join sections of oil string pipe together which form the downhole oil string casing. The magnetic coupling devices are placed at every 1,000 to 1,500 feet.

U.S. Pat. No. 5,453,188 issued to Florescu, et al. on Sep. 26, 1995 suggests an apparatus and method for preventing and minimizing the formation of deposits of paraffin, asphaltene and scale on the inside of downhole oil string line and on the surface of flow transmission lines. Successive magnet pairs are provided in magnetic discs along a section of pipeline. Each successive pair of magnets is rotated through a particular angle relative to the adjacent pair of magnets to achieve an advantageously prolonged trajectory of charged particles that populate the flowing fluid.

U.S. Pat. No. 5,700,376 issued to Carpenter on Dec. 23, 1997 describes an apparatus and method including first and second housing halves which are welded together to attach the apparatus to a pup joint installed in an oil casing. The housing includes a cylindrical portion and first and second frustoconical portions at opposite axial ends thereof. Axially extending L-shaped spacers are secured to the inside portion and include longitudinal edges which abut with the outer surface of the pipe. Series of axially spaced, first and right parallelepiped shaped magnets are sandwiched between the inside portion of the cylindrical portion and the outer surface of the pipe, with the poles of the first and magnets being reversed relative to the pipe. The housing halves are welded along their longitudinal free edges after being clamped together by a clamping band with sufficient force to secure the apparatus to the pipe generally by frictional forces and being free of the attachment to the pipe, and are secured along the casing pipe at approximately 1,000-foot intervals.

A Federal Technology Alert produced for the U.S. Dept. of Energy by Battelle Columbus Operations in January 1998 discloses the use of magnetic or electromagnetic scale control on a pipe through which water is flowing. It also discloses that manufacturers have applied the technology to petroleum pipelines to prevent wax build-up. A variety of other studies regarding the use and mechanisms of the use of magnets in treating scale, paraffin and asphaltene during petroleum production, including those by Farshad, F. F. et al. [SPE paper No. 77850, 2002; and, SPE paper No. 76767, 2002], and Tung, N. P., et al. [SPE paper No. 68749, 2001].

Although the use of magnetic scale prevention has proven effective for both residential and commercial applications at or near the surface, magnetic scale prevention for down-hole oil and gas production tubulars has been problematic. Lack of success in down-hole magnetic scal prevention has several contributing factors, including a lack of understanding of the fluid dynamic characteristics that exist during normal production of a producing oil and gas well and improper use and configuration of the technology.

For example, magnets have been clamped on the exterior of the production tubing as the production tubing being run into the wellbore. In this configuration, the clamps extend outside of the outer diameter of the tubulars and come in contact with the sides of the well-bore and debris in the annulus between the well-bore and the production tubular. The clamps can become jarred or dislodged during the installation of the production tubing, which allows the magnetic scale assembly to become separated or torn away from the production tubulars. Thus, these clamps can become lost or stuck in the wellbore and then require additional expensive fishing operations for their recovery. The protrusion of magnets on the exterior of the tubing will also limit the ability of the magnets to be conveyed into the wellbore or reservoir in a pressurized condition. This pressurized deployment is referred to as snubbing or stripping into the well. This stripping or snubbing is generally accomplished by the use of elastomers or rubber sealing elements which provide a seal on the exterior of the production tubing as it is pushed or lowered in and out of the well-bore. Snubbing or stripping requires that the outside diameter of the tubing or conduit be smooth to prevent oil, gas or hydrocarbons from being released into the atmosphere during this insertion. The uncontrolled release of oil, gas or hydrocarbons into the atmosphere is referred to as a blowout and, in some scenarios, may result in an explosion or fire. Therefore the use of any assembly that cannot provide a smooth exterior that would allow for these elastomers to seal on would not be recommended by those skilled in the art of oil and gas well servicing. It is always preferred in oil and gas well servicing, whether snubbing or stripping is being performed or not, to maintain the ability to seal on the exterior of the production tubing, since the ability to seal on the exterior of the tubing can be used to trap or contain pressure should the well begin to flow unexpectedly.

In another prior art embodiment, small individual magnets were placed into a subassembly (also referred to as a sub) that is placed between two joints of tubing. Although this configuration eliminates the clamps, the size of the magnets are limited by the interior diameter of the casing and the exterior dimension of the production tubing, and, thus, only smaller, lower strength magnets may be used. In an attempt to compensate for the loss in strength due to the smaller dimension of the magnets, the subs were made out of a nonferrous material. Although the use of nonferrous subs can reduce distortion and magnetic field strength losses, the strength of the magnets proved to be ineffective. This is further complicated when many small magnets having the same polarization are placed side by side. The alignment and the natural repelling effects generated by magnets with the same polarization in proximity to one another causes great distortion in the field of magnetic flux generated by the individual magnets. Additional energy is lost from the already limited strength of the magnets, and the field of magnetic flux becomes heavily distorted. Thus, uniform penetration of the tubular with the magnetic field and the energy transfer to the fluid is not fully accomplished. Additionally, this prior art embodiment did not give consideration or provide mechanisms to change the interior velocity of the fluid as it passes through the magnetic field.

Recent research has shown that, for magnets to be effectively used in the prevention of scale, the interior fluid velocity must be maintained at a minimum level, or critical velocity. When fluid velocities drop below this critical velocity, the proper ion arrangement does not occur. Previous prior art embodiments provide no mechanism for fluid acceleration through the magnetic fielding beyond the natural velocity maintained by the interior diameter of the production tubing. This is due to a lack of understanding of the velocity and or production mechanics of oil and gas wells production rates. For those skilled in the art of production recovery, it is understood that velocities or production rates will vary from well to well and will change throughout the life of a single well. This generally occurs when the well begins to lose pressurization or become depleted over time as the oil is produced. This loss of pressurization will further result in a decrease in the well's production velocity.

Research has shown that proper polar alignment of the magnets must be maintained to keep the particles in the tubular contained within the fluid. Incorrect polar alignment results in the acceleration of scale deposition. It has been firmly established in the scientific world, that the positive, magnetic flux field influence of the South Pole changes the adhesion characteristic of liquids making them become more soluble. This occurs when the ions are arranged as they pass through the magnetic field of north to south orientation. The positive effect of the South Pole will repel the positively charged particles contained in the fluid. This repelling effect will cause the particles to change from a random arrangement to a structured arrangement. This effect is referred to as Kronberg Platet Formation. By arranging the magnetic field so as to pass through the positive or South Pole last, the positive sides of the particles are furthest from the negatively charged piping. This realignment of the ions then carries the positive charge from the south polarization. This retained magnetic charge is referred to as magnetic memory effect. This memory or charge has been measured in static bodies of fluid up to one year from the induction. However, consideration must be given to the discharge or loss of magnetic polarization that occurs as fluid is transported through long intervals of piping. This discharge occurs due to turbulence in the fluid, wherein the ions are shuffled and the net charge is lowered. The disruption in the magnetic memory is referred to as Vibrational Depolarization. Vibrational depolarization occurs when a fluid that has had a charge induced into is affected by the turbulent effect of the pipe or conduit it is being moved through. The greater the turbulence of the fluid the quicker the polarization or charge is lost. Due to vibrational depolarization, the magnetic memory of the particles must be reestablished at intervals no greater than 250 feet, in order to keep particles contained within the fluid medium and prevent scale deposition. At these intervals the charge has proven effective to keep the particles in the fluid from precipitating out and forming scale. It has also been shown, where scale deposits already exist, reestablishing the field at intervals of about 165 feet can attract particles back into the fluid medium, removing at least part of the scale deposits from the tubular walls and thereby causing a reduction of the existing scale. This occurs when the particles in the fluid have a stronger induced polarity than the particles have to other scale crystals or the tubing walls itself.

Additionally, most prior art embodiments fail to take into account the extreme bottom hole temperatures that may exist in oil and gas wells. It is generally known by those skilled in the art of oil and gas production that scale precipitation can be most severe on the wells that have the highest bottom hole temperatures and pressures. It has been shown that magnets degrade or lose strength more rapidly under higher temperature operations. Therefore the use of magnets that have not been properly designed to endure the higher temperatures will result in degradation and failure.

Extreme conditions may weaken or nullify the strength of the magnets before they can influence the particles in the fluids. Magnetic fields are essential in producing a magnetic memory effect in the particles. This positions the particles in the stronger magnetic field generated by the cylindrical magnet for increased lengths of time to insure proper energy transfer to the ion arrangement of the particles. This magnetic memory effect causes the particles (that in effect have become small magnets) to group together, which helps to neutralize their polarity or charge. When the polarity of the particles is neutralized or reduced, the particles tend to remain in the fluid for longer periods of time.

The magnetic memory in the particles may be induced by a magnet is orientated in the wellbore, such as a one-piece cylindrical magnet, so that the fluid passes from a North Pole to the South Pole orientation. This allows the positive charge from the south polar field to be the last to influence the fluid and the particles are before leaving the flux field. It has been shown in the scientific community that South polar effect (positive charge) causes the particles to be less affected by the polarity of the production tubing, therefore maintaining the magnetic memory over greater distances. However this magnetic memory effect can be disrupted as the fluid passes through the interior of the piping over long intervals.

A shortcoming of prior art magnetic deposition prevention systems is that the magnet can be damaged during insertion and/or removal of the production tubular into/from the well due to contact with the inner wall of the casing.

Another shortcoming of the prior magnet deposition prevention systems is that the magnet may be crushed by compression forces along the length of the production tubular or the magnetic retainer.

For these reasons the need to develop magnetic subs designed specifically for scale inhibition of down-hole oil and gas production tubulars exists. There is a need for a downhole magnetic deposition apparatus that protects the magnet from longitudinal compression forces and damage from contact with the casing.

BRIEF SUMMARY OF THE DISCLOSURE

In aspects, the present disclosure is related to methods and apparatuses for magnetic scale deposition reduction.

One embodiment according to the present disclosure includes an apparatus for magnetically treating fluids flowing through a conduit to inhibit the formation and/or deposition of solid phase deposits within the conduit, the apparatus comprising: a tubular box member configured to be interconnected with a first conduit in an axial manner, the tubular box member comprising: a first tubular box portion with a first tubular box outer diameter; a second tubular box portion with a second tubular box outer diameter; and a third tubular box portion with a third tubular box outer diameter, wherein the second tubular box portion is disposed between the first tubular box portion and the third tubular box portion; a tubular pin member comprising: a first tubular pin portion with a first tubular pin portion outer diameter and a first tubular pin portion inner diameter; and a second tubular pin portion with a second tubular pin portion inner diameter;

wherein the first tubular pin portion is configured to be interconnected with the third tubular box portion in an axial manner, and wherein the second tubular pin portion is configured to be interconnected with a second conduit in an axial manner; a cylindrical magnet having a North magnetic pole, a South magnetic pole, a magnet outer diameter, and a magnet inner diameter and disposed around at least part of the second tubular box portion; and wherein; the first tubular box portion outer diameter is greater than the cylindrical magnet outer diameter; the second tubular box portion outer diameter is equal to or smaller than the cylindrical magnet inner diameter; the third tubular box portion outer diameter is smaller than the first tubular pin portion inner diameter; the first tubular pin portion outer diameter is greater than the magnet outer diameter; and the first tubular pin inner portion diameter is smaller than the third tubular box portion outer diameter.

Another embodiment according to the present disclosure includes a system for reducing buildup in a hydrocarbon flow path located in a subterranean well, comprising: a plurality of magnetic subs disposed between hydrocarbon conduits at regular intervals in a subterranean well bore, wherein each of the magnetic subs comprises: a tubular box member configured to be interconnected with a first conduit in an axial manner, the tubular box member comprising: a first tubular box portion with a first tubular box outer diameter; a second tubular box portion with a second tubular box outer diameter; and a third tubular box portion with a third tubular box outer diameter, wherein the second tubular box portion is disposed between the first tubular box portion and the third tubular box portion; a tubular pin member comprising: a first tubular pin portion with a first tubular pin portion outer diameter and a first tubular pin portion inner diameter; and a second tubular pin portion with a second tubular pin portion inner diameter; wherein the first tubular pin portion is configured to be interconnected with the third tubular box portion in an axial manner, and wherein the second tubular pin portion is configured to be interconnected with a second conduit in an axial manner; a cylindrical magnet having a North magnetic pole, a South magnetic pole, a magnet outer diameter, and a magnet inner diameter and disposed around at least part of the second tubular box portion; and wherein; the first tubular box portion outer diameter is greater than the cylindrical magnet outer diameter; the second tubular box portion outer diameter is equal to or smaller than the cylindrical magnet inner diameter; the third tubular box portion outer diameter is smaller than the first tubular pin portion inner diameter; the first tubular pin portion outer diameter is greater than the magnet outer diameter; and the first tubular pin inner portion diameter is smaller than the third tubular box portion outer diameter.

Another embodiment of the present disclosure includes a process for removing or inhibiting the formation of solid phase deposits from hydrocarbons, the process comprising: connecting an apparatus to an end of a first conduit running, the first conduit and associated system in a subterranean well, wherein the apparatus comprises: a tubular box member configured to be interconnected with a first conduit in an axial manner, the tubular box member comprising: a first tubular box portion with a first tubular box outer diameter; a second tubular box portion with a second tubular box outer diameter; and a third tubular box portion with a third tubular box outer diameter, wherein the second tubular box portion is disposed between the first tubular box portion and the third tubular box portion; a tubular pin member comprising: a first tubular pin portion with a first tubular pin portion outer diameter and a first tubular pin portion inner diameter; and a second tubular pin portion with a second tubular pin portion inner diameter; wherein the first tubular pin portion is configured to be interconnected with the third tubular box portion in an axial manner, and wherein the second tubular pin portion is configured to be interconnected with a second conduit in an axial manner; a cylindrical magnet having a North magnetic pole, a South magnetic pole, a magnet outer diameter, and a magnet inner diameter and disposed around at least part of the second tubular box portion; and wherein; the first tubular box portion outer diameter is greater than the cylindrical magnet outer diameter; the second tubular box portion outer diameter is equal to or smaller than the cylindrical magnet inner diameter; the third tubular box portion outer diameter is smaller than the first tubular pin portion inner diameter; the first tubular pin portion outer diameter is greater than the magnet outer diameter; and the first tubular pin inner portion diameter is smaller than the third tubular box portion outer diameter; connecting and running additional conduits and systems so as to have at least a plurality of systems longitudinally spaced apart from one another in the wellbore; and flowing a hydrocarbon-bearing fluid the systems.

Another embodiment according to the present disclosure includes an oil or gas production process, comprising: establishing a hydrocarbon flow path in a subterranean well, the flow path comprising an inner surface and an outer surface and adapted to flow a hydrocarbon-bearing fluid from a distal end to a proximal end; providing a substantially cylindrical permanent magnet adjacent the outside surface such that a North magnetic pole is adjacent the distal end and a South magnetic pole is adjacent the proximal end, the magnet having an outer surface and first and second axially spaced ends; limiting movement of a top box and bottom pin combination configured to threadingly engage one another, wherein the magnet is disposed around a portion of the top box, and the bottom pin comprises a shelf stop to limit the threading engagement between the top box and the bottom pin before the magnet is longitudinally compressed by the top box and bottom pin; and providing a first conduit portion located adjacent the first end of the magnet; providing a second conduit portion adjacent the second end of the magnet; and resulting in an outer diameter of the first and second conduit portions that is equal to or greater than the outer diameter of the shield.

Examples of the more important features of the disclosure have been summarized rather broadly in order that the detailed description thereof that follows may be better understood and in order that the contributions they represent to the art may be appreciated. There are, of course, additional features of the disclosure that will be described hereinafter and which will form the subject of the claims appended hereto.

BRIEF DESCRIPTION OF THE DRAWINGS

A better understanding of the present disclosure can be obtained with the following detailed descriptions of the various disclosed embodiments in the drawings, which are given by way of illustration only, and thus are not limiting the present disclosure, and wherein.

Figure 1:
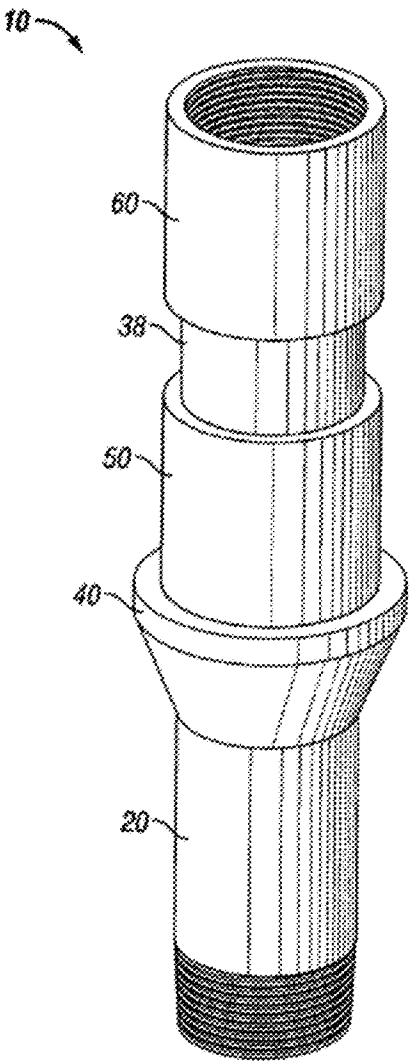
FIG. 1 shows a perspective view of a magnetic assembly according to one embodiment of the present disclosure.

While the inventions disclosed herein are susceptible to various modifications and alternative forms, only a few specific embodiments are shown by way of example in the drawings and are described in detail below. The figures and detailed descriptions of these specific embodiments are not intended to limit the breadth or scope of the inventive concepts or the appended claims in any manner. Rather, the figures and detailed written descriptions are provided to illustrate the inventive concepts to a person of ordinary skill in the art, and to enable such persons to make and use one or more of the inventive concepts.

DETAILED DESCRIPTION OF THE DISCLOSURE

In aspects, the present disclosure is related to methods and apparatuses for magnetic scale deposition reduction. Specifically, the present disclosure is related to preventing scale formation or removing existing scale using magnets, and protecting those magnets from damage during installation, operations, and removal. The present invention is susceptible to embodiments of different forms. There are shown in the drawings, and herein will be described in detail, specific embodiments with the understanding that the present invention is to be considered an exemplification of the principles and is not intended to limit the present invention to that illustrated and described herein.

One or more illustrative embodiments incorporating the invention disclosed herein are presented below. Not all features of an actual implementation are described or shown in this application for the sake of clarity. It is understood that in the development of an actual embodiment incorporating the present invention, numerous implementation-specific decisions must be made to achieve the developer's goals, such as compliance with system-related, business-related, government-related and other constraints, which vary by implementation from time to time. While a developer's efforts might be complex and time consuming, such efforts would be, nevertheless, a routine undertaking for those of ordinary skill in the art having the benefit of this disclosure.

Accordingly, it is an object of the present invention to provide a magnetic apparatus and system, as well as an associated method for preventing the accumulation of unwanted solid deposits in production tubing that fully integrates with a hydrocarbon carrying conduit, such as a downhole tubing string; can be easily assembled; can be easily installed on the pipeline as the pipeline is being assembled, or, can be easily incorporated into pre-existing downhole tubing; and, removes and prevents unwanted solid deposit formation or accumulation (e.g., scale formation) without the need for monitoring.

In general terms, permanent magnets, such as, but not limited to, cylindrical rare earth magnets, may be disposed adjacent the hydrocarbon flow line or other flow equipment to prevent and/or reduce unwanted deposit buildup. In general, a magnetic assembly including one or more permanent magnets may be oriented such that hydrocarbon flow is from the North magnetic pole to the South magnetic pole. The devices and methods discussed herein include original equipment for use downhole and retrofit equipment to modify existing downhole equipment.

While compositions and methods are described in terms of "comprising" various components or steps (interpreted as meaning "including, but not limited to"), the compositions and methods can also "consist essentially of" or "consist of" the various components and steps, such terminology should be interpreted as defining essentially closed-member groups.

In some embodiments, a magnetic assembly includes a one-piece cylindrical magnet, a magnet retention device, and a collar. The cylindrical magnet may be disposed around the magnet retention device, which may have a flange upon which the magnet sits. A collar may engage a first end of the magnet retention device and retains the magnet on the magnet retention device. The collar further engages adjacent pipeline. The magnet retention device is provided with threads on a second end to engage adjacent pipeline. A plurality of magnetic subassemblies can be included along the pipeline at intervals up to about every 400 to about 500 feet. Other features and advantages of the invention will be apparent from the following description, the accompanying drawing and the appended claims.

FIG. 1 shows a magnetic assembly 10 which includes a magnet retention device 20, a magnet 50 and a collar 60. Magnetic assembly 10 readily integrates into downhole production tubing or piping (not shown), thereby providing fluid communication between tubing strings (not shown) adjoined by magnetic assembly 10.

Figure 2:
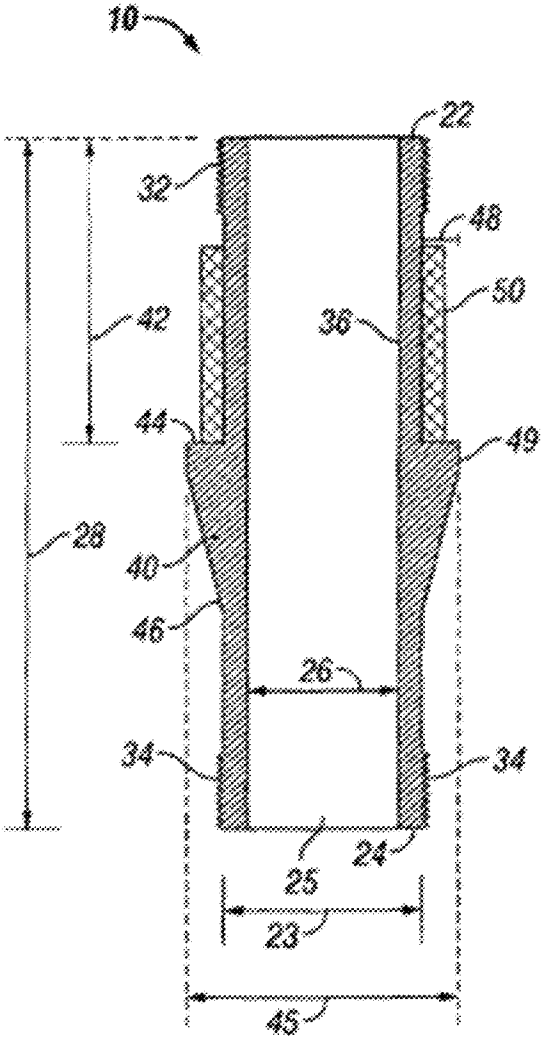
FIG. 2 shows a cross sectional view of a magnet retention device in accordance with FIG. 1.

FIG. 2 shows a cross sectional view of the magnet retention device 20, wherein the magnet retention device 20 has a generally tubular shape with an inner surface 36 defining an orifice 25 providing communication between a retention device first end 22 and a retention device second end 24. In some embodiments, the orifice 25 may, optionally, have a constant orifice diameter 26 throughout the device length 28 of retention device 20.

First end threads 32 are provided proximate to the retention device first end 22 and second end threads 34 are provided proximate to retention device second end 24. The first end threads 32 engage the collar 60 shown in FIG. 1. The second end threads 34 are used to threadably connect the magnetic assembly 10 to an adjacent pipeline (not shown).

The magnet retention device 20 has a device wall 30 having an outer diameter 23. The device wall 30 has a wall thickness 31, which is measured between device inner surface 36 and device outer surface 38.

A flange 40 is provided along retention device 20 at a length 42 from first end 22. Magnet 50 typically rests upon a top surface 44 of flange 40, thus flange 40 maybe buttressed on a bottom surface 46 to provide additional support. The flange 40 has a flange width 48, which is the distance from the device outer surface 38 to a flange edge 49. The flange 40 encircles the device wall 30 and has a flange diameter 45.

Figure 3:
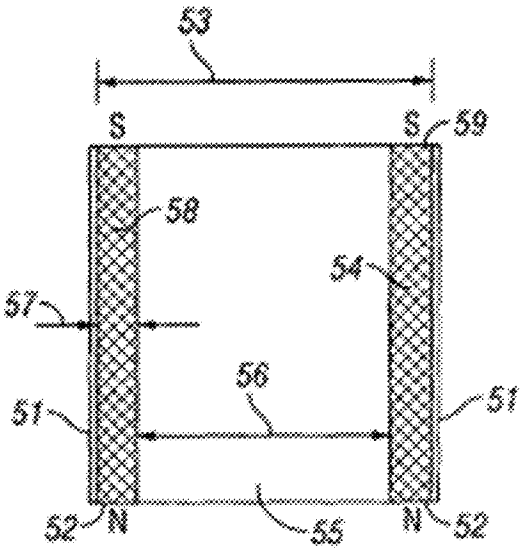
FIG. 3 shows a cross sectional view of a magnet for use in embodiments of the present disclosure.

Referring now to FIG. 3, the magnet 50 is substantially cylindrically shaped with an opening 55 there through. The magnet 50 has a magnet inner diameter (i.d.) 56 and a magnet outer diameter (o.d.) 53. The magnet i.d. 56 is larger than the magnetic retention device 20 outer diameter 23, thereby permitting the magnet 50 to slide over the first end 22 when the collar 60 is not present. The magnet inner diameter 56 is smaller than the flange diameter 45, thereby allowing the magnet 50 to be prevented from sliding beyond the flange 40 toward the second end 24 of magnetic retention device 20. The magnet o.d. 53 can be less than or equal to the flange diameter 45.

In one aspect of the present disclosure, the magnet outer diameter 53 is less than flange outer diameter 45 so that the magnet 50 is substantially protected and not lifted off from the flange 40 while the magnetic assembly 10 is lowered downhole. In one aspect of the present disclosure, when the magnet 50 is placed onto magnet retention device 20, the North pole 52 of the magnet 50 can be facing the flange top surface 44. That is, the cylindrical magnet is installed in a North (negative) to South (positive) flow direction, relative to the flow of hydrocarbons through the conduit. However, the magnet 50 can optionally also be placed onto the magnet retention device 20 in such a manner that the North pole 52 of the magnet 50 is oriented opposite the flange top surface 44, and the South pole 59 is facing the flange top surface 44 (not shown)—that is, in a South (positive) to North (negative) flow direction.

Figure 4:
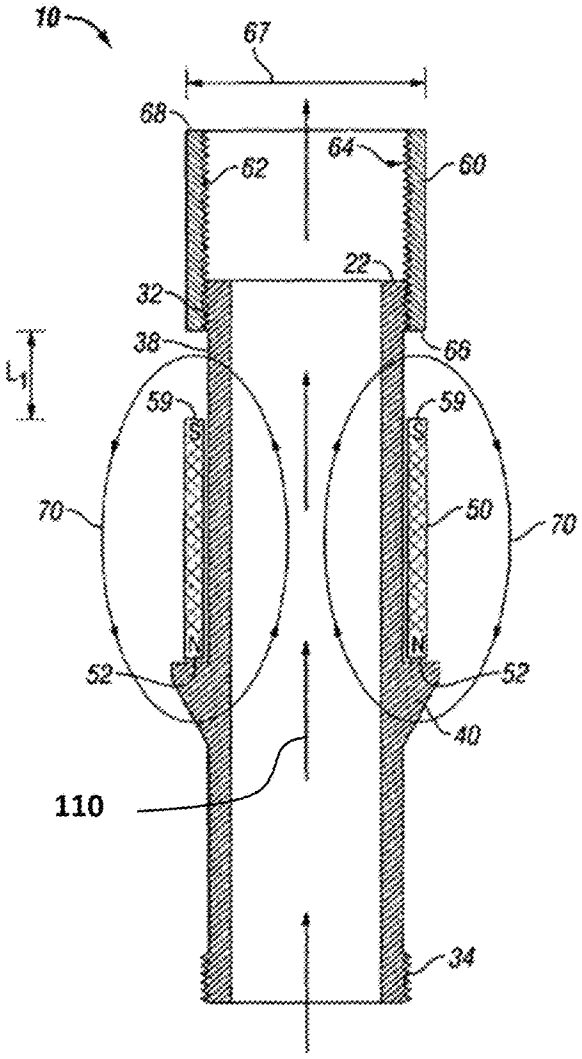
FIG. 4 shows a cross sectional view of the magnetic assembly of FIG. 1, taken along line A-A.

FIG. 4 shows the fluid flow and magnetic flux directions with respect to the magnet 50 for the cross section of FIG. 2. The fluid flows through the orifice 25 in a north-to-south direction, as represented by arrows 110. With respect to fluid flow parameters, the rate of fluid flow through the orifice 25 can have a critical flow velocity such that the spacing of a plurality of magnetic assemblies 10 along a tubing string can be preferably maximized, e.g., from about 400 feet to about 500 feet apart. However, as the critical flow velocity changes, so too may the spacing of the magnetic assemblies. Examples of suitable critical fluid flow velocities, in accordance with the present disclosure, include fluid flow velocities ranging from about 1 ft/sec to greater than 100 ft/sec, including about 1 ft/sec, 2 ft/sec, 3 ft/sec, 4 ft/sec, 5 ft/sec, 6 ft/sec, 7 ft/sec, 8 ft/sec, 9 ft/sec, 10 ft/sec, 20 ft/sec, 30 ft/sec, 40 ft/sec, 50 ft/sec, 60 ft/sec, 70 ft/sec, 80 ft/sec, 90 ft/sec, 100 ft/sec, as well as velocities greater than 100 ft/sec and ranges between any two of these fluid flow velocities, e.g., from about 7 ft/sec to about 60 ft/sec. It will be apparent to those of skill in the art, however, that fluid flow velocity is not the only parameter upon which spacing of the magnetic subassemblies can rely, as other factors such as tubing diameter can have an effect on the spacing of a plurality of magnetic assemblies 10.

While not wishing to be limited by any one theory of operation, it is presently believed that the resulting magnetic field 70 induces polarization of fluid molecules (not shown) passing through field 70 in such a manner that molecules are repelled by the magnetic field and by other polarized molecules. As a result, molecules are less likely to attach to each other and to crystallize and adhere to the inner surface 36 of assembly 10 or to the inner surface of the downhole piping or tubing (not shown), thereby preventing scale buildup. This likely occurs as a result of the influence of the positive, magnetic flux of the South Pole, which changes the adhesion characteristics of liquids, making them more soluble. This is believed to occur when the ions are arranged in the fluid as they pass through a magnetic field of North to South orientation. As such, the positive effect of the South pole will repel the positively charged particles contained in the fluid, and will thus cause the particles to change from a random arrangement to a structured arrangement. By arranging the magnetic field such that particles pass through the positive, or South Pole, last, the positive side of the particles thus becomes the farthest spaced from the negatively charging conduit, or tubing. This realignment of the ions then carry, or retain, the positive charge from the South polarization known as the magnetic memory effect.

Returning to FIG. 3, the magnet 50 has a magnet inner surface 54, which faces the device outer surface 38 when the magnet 50 is assembled onto the magnet retention device 20. The magnet 50 has a magnet wall 58, which has a magnet wall thickness 57. In one embodiment, the magnet 50 is a rare earth magnet, either sintered or bonded, of the samarium cobalt (SmCo) type, such as the sintered SmCo magnets available from Swift Levick Magnets (Derbyshire, U.K.). As used herein, the term "rare earth magnets" is meant to include magnets composed of alloys of the Lanthanide group of elements, as well as rare-earth transition metal magnets. Samarium cobalt magnets suitable for use herein include, but are not limited to, sintered SmCo magnets, as well as samarium cobalt alloy magnets, including both $SmCo_5$ and $Sm_2Co_{17}$ type magnets. A samarium cobalt magnet may be selected as the magnet 50 because of its properties with regard to corrosion resistance/resistance to oxidation, magnetic strength, structural strength, and thermal stability. Other rare-earth type magnets are also suitable for use herein, depending upon the particular environment in which it will be used. Such magnets include hard ferrite (strontium hexaferrite, $SrO\text{-}6(Fe_2O_3)$) magnets, beryllium-copper magnets, neodymium-iron-boron (NdFeB) magnets, For example, in applications wherein the ambient temperature is less than 150 degrees F. (65.6 degrees C.), a rare earth magnet of the neodymium-iron-boron (NdFeB) type may be suitable for use.

Referring to FIGS. 1 and 4, after the magnet 50 is resting on the flange 40 of the magnet retention device 20, the collar 60 may be attached to prevent the magnet 50 from sliding over the first end 22. The collar 60 may include collar threads 62 or other coupling mechanisms along the collar inner surface 64. The collar threads 62 are configured to accept the first end threads 32 so that the collar 60 is threadably engaged at a collar first end 66 with first end 22 of the magnet retention device 20. The collar 60 has a collar outer diameter 67, which is typically greater than the magnet inner diameter 56 (shown in FIG. 3); thereby ensuring that the magnet 50 is retained between the flange 40 and the collar 60.

In one aspect of the present disclosure, and shown in FIG. 4, the collar first end 66 can be separated from the magnet 50 by a spacing $L_1$, allowing the magnet 50 to move longitudinally along the device outer surface 38. The collar threads 62 also permit removal of the collar 60, allowing for replacement of the magnet 50 as necessary. The collar threads 62 may extend along the inner surface 64 of the collar 60 from the collar first end 66 to a collar second end 68. The collar threads 62 proximate the collar second end 68 are used to connect the magnetic assembly 10 to adjacent conduit or pipe (not shown).

Figure 5:
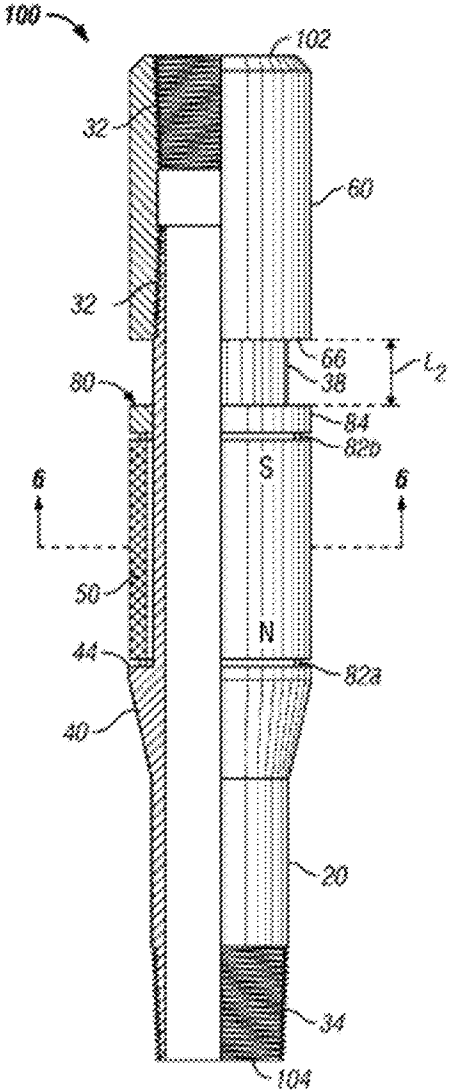
FIG. 5 shows a half-section view of an assembly in accordance with one embodiment of the present disclosure.

FIG. 5 shows a further aspect of the present invention, wherein a magnetic assembly 100 comprises the magnetic retention device 20, the flange 40, the magnet 50, the collar 60 and a lock nut 80. The assembly 100 has a proximal end 102 and a distal end 104, spaced longitudinally apart. Both the proximal end 102 and the distal end 104 terminate in end threads 32 and 34, respectively. The proximal end 102 is shown with the first end threads 32 and the secondary first end threads 32', both of which threadably engage the collar 60 at the proximal end 102 of the assembly 100. The distal end threads 34 are configured to threadably connect the magnetic assembly 100 to an adjacent conduit or pipe.

The flange 40 along retention device 20 is disposed in the assembly 100 such that the flange 40 is longitudinally displaced from the distal end 104. The magnet 50 rests atop the flange 40, but is constrained from longitudinal movement along the outer surface 38. While shown with the North (N) magnetic pole of the magnet 50 oriented towards the distal end 104 of assembly 100 and the South (S) magnetic pole of the magnet 50 oriented towards the proximal end 102 of assembly 100, a person of ordinary skill in the art would understand that these orientations may be reversed, and that a plurality of the magnets 50 could be used, provided they do not extend outwardly away from the outer surface 38 past the outer edge of the flange 40.

As is further shown in FIG. 5, the magnetic assembly 100 also comprises at least two seals 82*a* and 82*b*, and the lock nut 80. The seal 82*a* forms an interface between the North magnetic pole (N) of the magnet 50 and the top surface 44 of the flange 40, while the seal 82*b* similarly forms an interface between South magnetic pole (S) of the magnet 50 and the bottom edge of the lock nut 80. The lock nut 80 is generally cylindrical in shape, with an opening there through (not shown), having a top face and a bottom face, and outer edge 84. The lock nut 80 is slidably added over the proximal end 102 of assembly 100 prior to the threadable attachment of the collar 60. Once slidably added over the outside edge 38 of the assembly 100, the lock nut 80 is compressed against the seal 82*b*, and is held in place by a plurality of threaded attachment means that attach the lock nut 80 via the outer edge 84 to the outside edge 38 of the assembly 100. Such threadable attachment means include set screws (e.g., slotted or socket set screws), countersunk screws, cup point socket set screws, knurled point socket set screws, oval point set screws, cone point set screws, and half-dog point set screws. The lock nut 80 thus retains the magnet 50 in position against the flange 40, and maintains a static, longitudinal distance $L_2$ between the top face of the lock nut 80 and the collar first end 66.

The seals 82*a* and 82*b*, as indicated previously, can be made of any number of sealing materials, including, but not limited to, elastomers, and can be in any suitable multiplicity (e.g., four seals). Typically, the seals 82*a* and 82*b* are O-rings or other similar, torus-shaped objects, which can be made from a number of elastomeric materials so as to seal against fluid movement. In the instance that the seals 82*a* and 82*b* are O-rings, they are typically inserted into cavities, known as glands, which can be either axial or radial, as known in the art. The O-ring seals 82*a* and 82*b* shown in FIG. 5 are illustrated in a radial seal geometry. The seals 82*a* and 82*b* can be made of any number of materials which can provide both chemical and temperature resistance in a downhole well bore environment. Such material typically has a temperature resistance in the range from about −26 degrees F. (−32 degrees C.) to about 600 degrees F. (316 degrees C.), and more typically from about −15 degrees F. (−26 degrees C.) to about 400 degrees F. (205 degrees C.). Suitable materials for use as the seals 82*a* and 82*b* may include, but are not limited to, fluorocarbon rubber (FKM)-type seals and O-rings, including KEL-F® and FLUOREL® (both available from 3M, St. Paul, Minn.), VITON® and KALREZ® (both available from E. I. DuPont de Nemours Co.); chlorosulfonated polyethylenes, such as HYPHALON® (available from DuPont Dow Elastomers); PTFE (TEFLON®) and filled PTFE such as FLUOROSINT® (available from Quadrant DSM Engineering Plastic Products, Reading, Pa.); copolymers of butadiene and acrylonitrile, known as Buna-N(nitrile; NBR), such as HYVCAR® (available from Goodrich Chemical Co.); and silicone or silicone rubber. Typically, the seals 82*a* and 82*b* are fluorocarbon rubber-type seals, such as VITON®.

Figure 6:
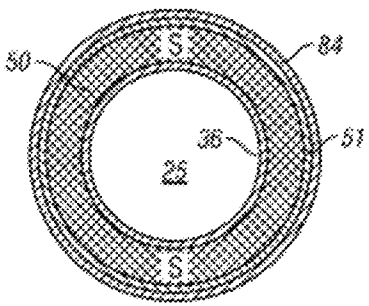
FIG. 6 shows an enlarged cross-sectional view of the assembly of FIG. 5, taken along line B-B.

FIG. 6 shows a cross-section of the sub-assembly of FIG. 5 taken along line 6-6 and showing several of the components of the magnetic assembly 10 which include many of the same components except for the collar 60 and the lock nut 80 in FIG. 5, but does include a section of the device wall 30 in contact with the magnet 50 of the hydrocarbon flow line. The device wall 30, which forms a boundary between the magnet 50 and the central orifice 25, includes the inner surface 36. The device wall 30 may be made of a non-magnetic metal or alloy material. The assembly 100 can further be seen to comprise the magnet 50 surrounding assembly 10, the magnet 50 having a protective shield 51. Also visible in FIG. 6 is the outer edge 84 of the lock nut 80, illustrating that the magnet 50 works in providing a smooth exterior that does not extend outside of the outer dimensions of the tubular.

In some embodiments, a protective shield 51 may be disposed around the magnet 50. The protective shield 51 is provided to prevent fracture of or reduce stress on magnet 50 in a downhole environment. The protective shield 51 can be of various materials having sufficient strength to provide added protection to the magnet 50. The protective shield 51 may be made of nickel, zinc, aluminum, or any other appropriate, metal or composite material. Exemplary materials for the protective shield 51 are one or more of non-magnetic nickel and a nickel-containing alloy.

Figure 7B:
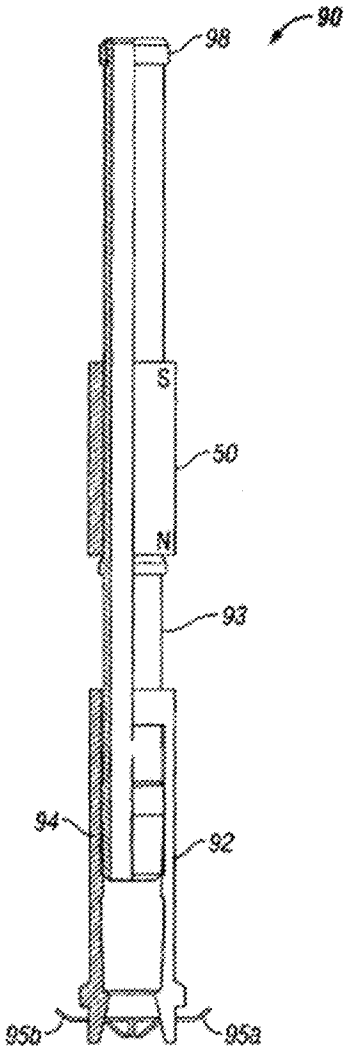
FIG. 7B shows a half-section view of the collar stop of FIG. 7A in open form.
Figure 7A:
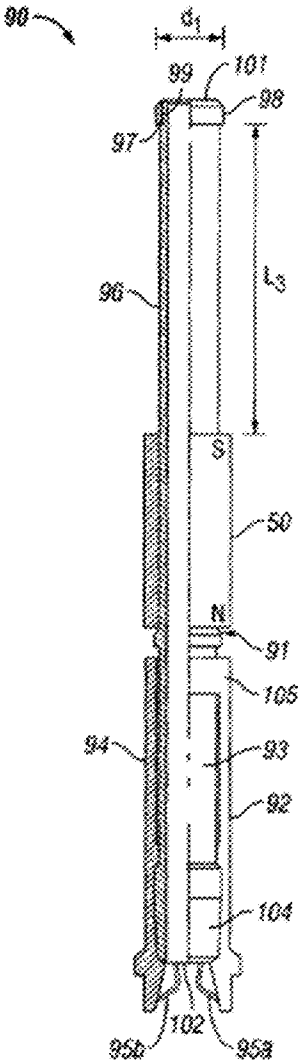
FIG. 7A shows a half-section view of a Type-F collar stop assembly in closed form, according to one embodiment of the present disclosure.

FIGS. 7A and 7B show another embodiment according to the present disclosure that includes a magnetic assembly 90 with a Type "F" collar stop (such as those available from FMS Inc., New Iberia, La.) comprising a main body 96, retention arms 92 and 94, locking pins 95*a* and 95*b*, a support flange 91, the magnet 50, and a lock nut 98. The magnet 50 is shown resting upon the flange 91. While not shown in FIG. 7A, the magnet 50 can also have seals above and below it along the longitudinal axis of the magnetic assembly 90, substantially similar to the seals shown in FIG. 5. After the magnet 50 is resting on the support flange 91, the lock nut 98 can be attached to prevent the magnet 50 from sliding over a proximal end 101 of the magnetic assembly 90. The lock nut 98 includes collar threads 99 along the inner surface, which accept end threads 97 on the proximal end 102 of magnetic assembly 90 so that the lock nut 98 is threadably engaged at the proximal end 102. The lock nut 98 has a collar outer diameter, $d_1$, which is typically greater than the outer diameter of the magnet 50, thereby ensuring that the magnet 50 is restrained between the lock nut 98 and the support flange 91. In one embodiment, the lock nut 98 is longitudinally separated from the magnet 50 by a length $L_3$, allowing the magnet 50 to move along the main body 96 of apparatus 90. The lock nut 98 is threadably attached, which allows for removal of the lock nut 98 so that the magnet 50 may be replaced as necessary.

The retaining arms 92 and 94 form a part of a retaining assembly 105, located at a distal end 102 of assembly 90. The retaining assembly 105 is slidably disposed along lower body 93 of assembly 90, having a lower end stop formed by a flanged end 104 at distal end 102, and an upper end stop formed by the support flange 91 which retains the magnet 50. At the distal end 102 of the retaining arms 92 and 94 are the locking pins 95*a* and 95*b*, which, when tripped by a running tool, release the retaining arms 92 and 94 and allow the apparatus 90 to lock into position, for instance in a collar gap.

FIG. 7B shows the magnetic assembly 90 in a position just prior to engagement. Following being run into the interior conduit of a tubing string, a wire tool operably engages and trips the locking pins 95*a* and 95*b*. The magnetic collar assembly 90 is then pulled back up the interior of the tubing string, wherein the retaining arms 92 and 94 latch the magnetic assembly 90 into one of the selected collars of the tubing string.

Figure 8:
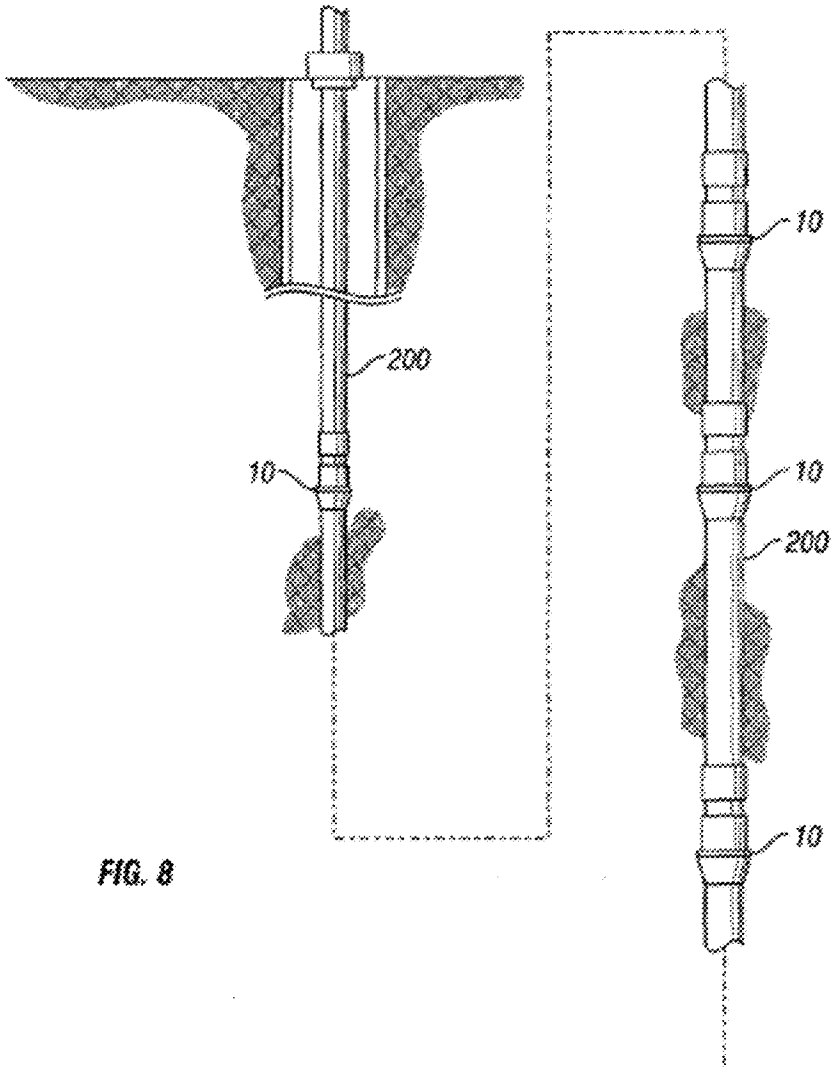
FIG. 8 shows an elevational view partly in section of a downhole production string including a plurality of subassemblies according to one embodiment of the present disclosure.

FIG. 8 shows a plurality or series of magnetic subassemblies 10 can be integrated into a pipe or tubing structure that is being placed down hole. In one aspect, the magnetic assemblies 10 are connected into the pipe or tubing 200 at intervals of approximately 400 to 500 feet. Other spacing arrangements may be provided within the scope of the invention, such that the spacing arrangements of magnetic assemblies 10 are in the range of from about 50 feet to about 500 feet, as well as ranges in between. Typical spacing ranges between magnetic assemblies 10 include, for example, about 50 feet, about 100 feet, about 150 feet, about 200 feet, about 250 feet, about 300 feet, about 350 feet, about 400 feet, about 450 feet and about 500 feet, as well as ranges between any two of these values, i.e. from about 150 feet to about 400 feet. As discussed previously, the magnetic field 70 produced by the magnet 50 within each of the magnetic assemblies 10 prevents unwanted solid phase buildup on the inside of the tubing 200.

Another set of embodiments according to the present disclosure provide a smooth substantially smooth production pipe string that integrates pipe tubulars and magnetic subs. The magnetic subs include a cylindrical magnet with an outer diameter equal to or less than the outer diameter of the sub. Since the outer diameter of the magnet does not extend beyond the outer diameter of the sub, the probability of damage to the magnet by rubbing against the interior of the well casing is reduced. This probability is further reduced when the outer diameter of the magnet is less than the outer diameter of the magnetic sub.

The magnetic subs smooth cylindrical exterior can further allow the use of the Blow-Out-Preventers (or BOPs as they are referred to), to be closed and provide a seal on the exterior of the subs. BOPs are primarily used to contain pressure sealing around the exterior of a cylindrical body with elastomers that are inserted into specially equipped rams. These rams are engaged on the exterior of the tubing or pipe to secure the wells pressure from being released into the atmosphere. These BOPs are generally reserved as a last resort barrier, or for securing the well at the end of each day.

Generally, the magnetic subs are configured to handle the same pressures and down hole environmental conditions as the production pipe tubulars. The cylindrical magnet may be disposed around a portion of the magnetic sub. This positioning and the dimensions of the cylindrical magnet allows the exterior of the magnet and the maximum outside diameter of the sub to have a seamless or substantially seamless cylindrical body. The smooth outer surface of the production pipe tubular and magnetic sub integration allows for elastomers to be closed around the exterior of the assembly without fear of damage to the elastomers due to protrusions and discontinuities in the surface of the production string. Reducing discontinuities in the surface of the production pipe string reduces the likelihood and damage caused by the production pipe string rubbing against the interior of the casing during snubbing and stripping. This stripping is a term generally referred to when the weight of the production tubing exceeds the force or reactive load generated by the pressurization of the well bore. However should the reactive load generated by the wells pressurization exceed the weight of the production tubing, therefore requiring the tubing to be forced into the wellbore by cylinders or cables, the term would be then referred to as snubbing. Although tubing can be installed into the wellbore in a dead or static condition live well or pressurized workovers play an ever-increasing role in well servicing applications. This increased use of live well workovers has been generally contributed to our increased understanding of the damage that can occur to the formation or down hole reservoir, when kill weight fluids or muds are used. Therefore the assembly has been configured to allow this pressurized insertion.

The sub and magnet fully integrated design further protects the magnet from damage on the trailing and leading edges to avoid damage to the assembly during insertion. Although the magnets may have a protective coating, such as the protective coating 51 shown in FIG. 6, that provides a high level of durability, the two-part magnetic sub provides additional protection on the trailing and leading edges that reduces or eliminates damage during workover operations or pipe insertion and extraction.

When the cylindrical magnets are sized to have a maximum outer diameter that approaches or equals the outer dimension of the magnetic sub, the amount of permanent magnetic material is maximized for a given length of the magnet. By optimizing the size of the magnet, the maximum available magnetic field strength may be provided for a selected permanent magnet made of a selected magnetic material. For those skilled in the art of oil and gas well servicing, the differential between the outer diameter of the any tools that may be run into the well bore and the inner diameter of the casing in the well bore is important. It is never recommended to run tools that are too close to the inside diameter of the casing in the well. A lack of clearance between the inside of the casing and the outside of the tool may make it impossible to recover or fish if the assembly should become lost or separated while in the well. Therefore the outer diameter of the magnetic sub is limited by the inner diameter of the casing while still allowing sufficient annular space between the tool and the casing to go over or fish the assembly from the well. The inner diameter of the casing sets the outer limits or maximum outside diameter of the magnetic sub assembly.

With the outer dimensions of the downhole tools being regulated by the inner diameter of the casing, the inside diameter or wall thickness of the sub that the magnet is installed on is also regulated by the required specifications of the tubing or the thickness of the tubing that is required to maintain the pressure integrity of the tubing. The differential between these two dimensions is the maximum dimension that is available for magnetic placement. The use of cylindrical magnets makes full use of all of this available area and allows the strongest magnet to be placed in the smallest dimension without jeopardizing integrity of the inner diameter of the casing to outer diameter of the production tubular differential for fishing or recovery operations. In some embodiments, the magnet is selected with an outer diameter that is smaller than both of the outer diameter 1011*a* and the outer diameter 1021*a* to prevent rubbing of the magnet against the casing.

Figure 9:
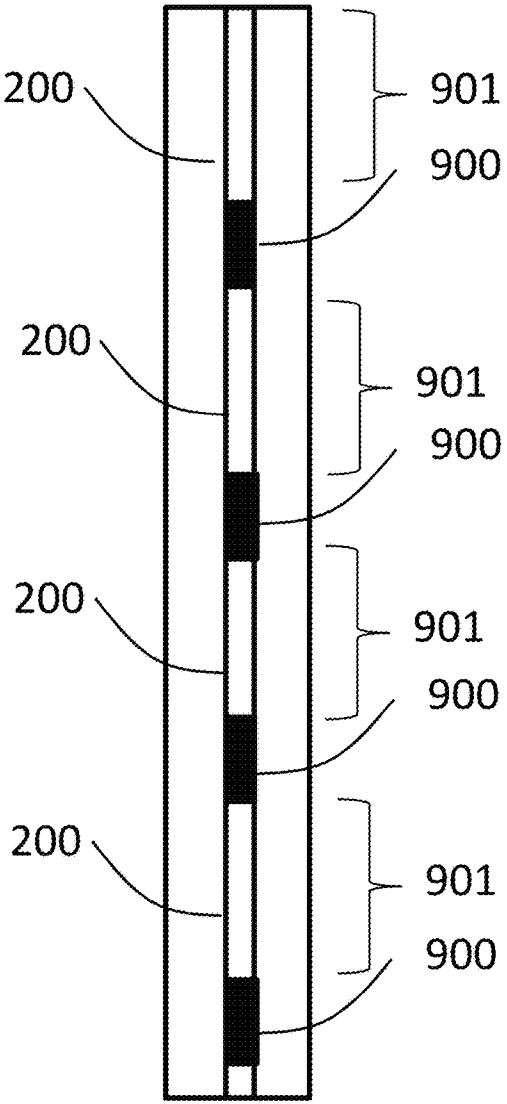
FIG. 9 shows a diagram of a plurality of magnetic subs in a tubular string in a well bore according to another embodiment of the present disclosure.

FIG. 9 shows another system according to the present disclosure where magnetic subs 900 are disposed in the string 200 at intervals 901 of about 250 feet or less. The magnetic subs 900 can be disposed at regular or irregular intervals between joints of production pipe. While any spacing between the magnetic subs can be used, spacing of about 250 feet or less may maintain the magnetic field sufficiently to prevent deposition and/or build up of particles on the walls of the pipe tubular 200. The magnetic subs 900 may be configured with the same load characteristics as the production tubulars. For those skilled in the art of oil and gas well servicing this is referred to as the specs or specifications of the tubing. These specs or specifications refer to the chemical composition, load bearing capability (yield & tensile) and pressure rating both internally (burst) and externally (collapse). These subs are designed in such a way as to be consistent with the tubing strings they are incorporated into. They can further be made of both ferrous and nonferrous materials. This composition will widely depend on the configuration or the specs of the tubing strings in which they are incorporated. The configuration of the subs however allows this without changing any of the characteristics of the magnetic assembly. Although the use of nonferrous material will absorb less of the energy generated by the magnetic fielding, the configuration of the cylindrical magnets provides enough energy to penetrate ferrous material and still effect the Ion arrangement of the interior production fluids.

Figure 10C:
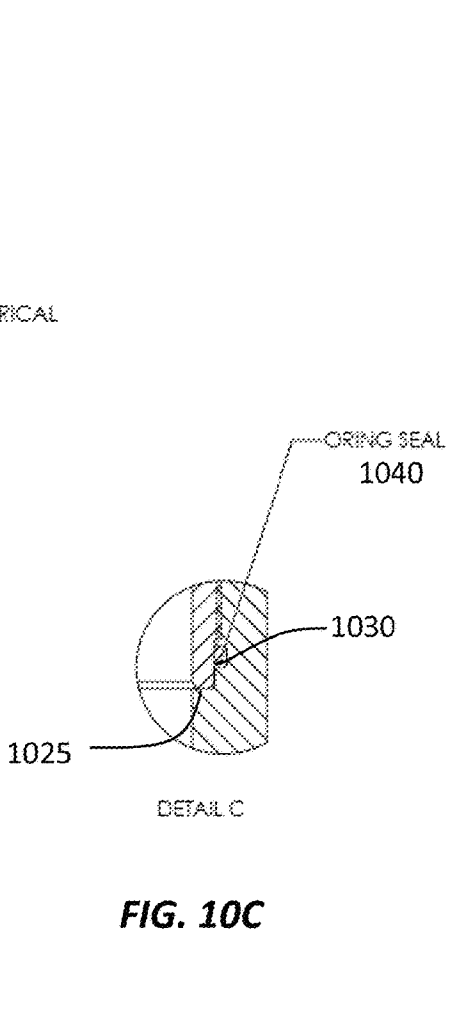
FIG. 10C shows a detailed view of O-ring seal of FIG. 10B.
Figure 10B:
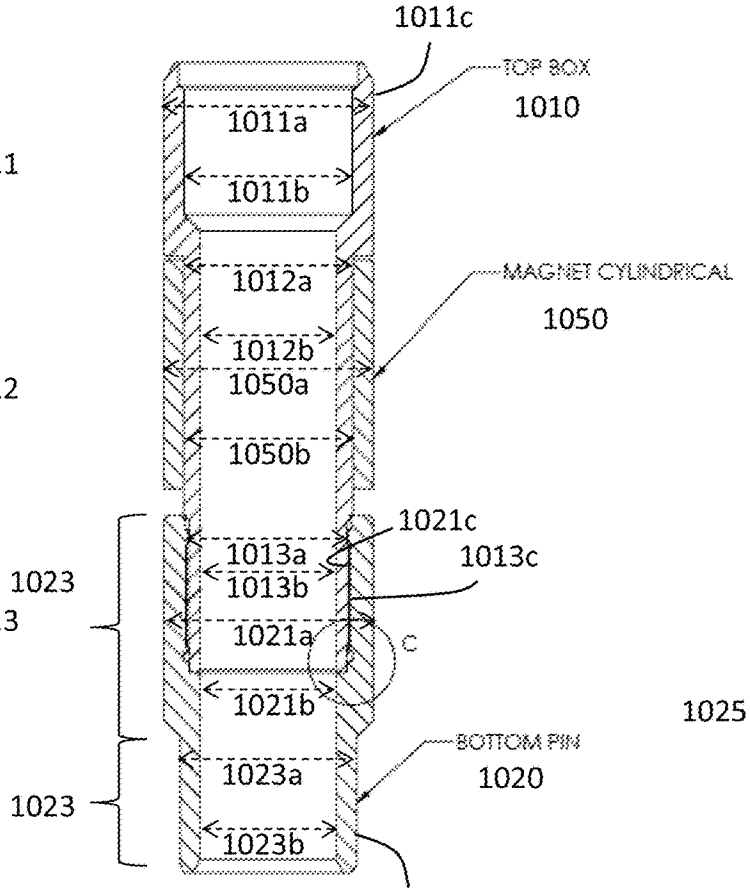
FIG. 10B shows a cross sectional view of the sub of FIG. 10A, taken along line B-B.
Figure 10A:
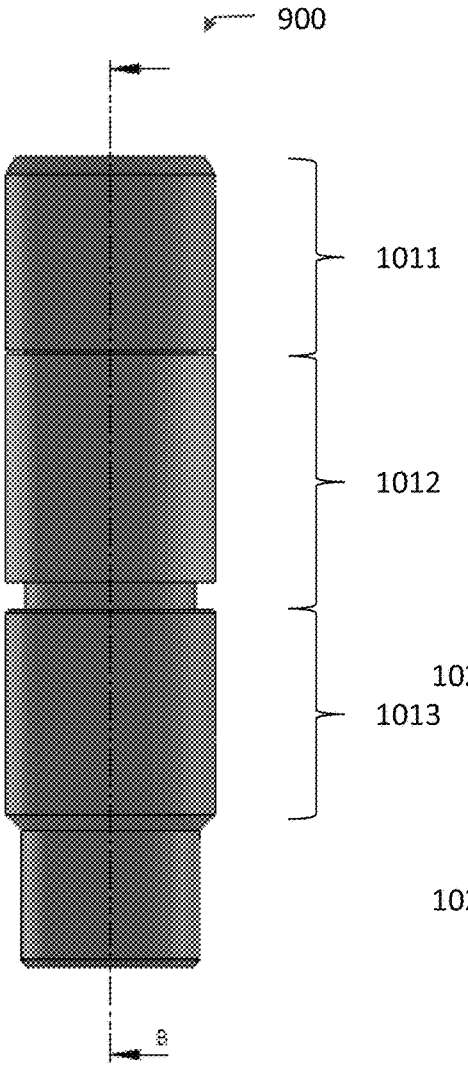
FIG. 10A shows a perspective view of an embodiment of the sub of FIG. 9 for mating hydrocarbon carrying conduits with the same diameters.

FIGS. 10A-10C show the magnetic sub 900 of FIG. 9 made of upper and lower parts. The upper part is a top box 1010 and the lower part is a bottom pin 1020. The top box 1010 and the bottom pin 1020 are both configured to connect with a tubular 200 and each other. As shown, the top box 1010 and the bottom pin 1020 each have outer diameters that are substantially similar. These outer diameters may also be substantially similar to the pipe tubulars 200 that may be connected on either side of the magnetic sub 1000 so that the substantially smooth outer surface exists for the pipe string formed by pipe tubulars and the plurality of magnetic subs 900. A cylindrical magnet 1050, similar to the magnet 50, is disposed around a recessed outer diameter section of the top box 1010. The cylindrical magnet 1050 has an outer diameter that is less than the largest outer diameter of the top box 1010 and is less than the largest outer diameter of the bottom pin 1020.

In detail, the top box 1010 is tubular and includes an upper portion 1011, a middle portion 1012, and a lower portion 1013. The upper portion 1011 has an outer diameter 1011*a* and an inner diameter 1011*b*; the middle portion 1012 has an outer diameter 1012*a* and an inner diameter 1012*b*; and the lower portion 1013 has an outer diameter 1013*a* and an inner diameter 1013*b*. The upper portion 1011 has an inner surface 1011*c* with threads configured to threadably engage a first pipe tubular (not shown). The lower portion 1013 has an outer surface 1013*c* with threads to threadably engage the upper portion 1021 of the bottom pin 1020. The bottom pin includes an upper portion 1021 and a lower portion 1023. The upper portion 1021 has an outer diameter 1021*a* and an inner diameter 1021*b*, and the lower portion 1023 has an outer diameter 1023*a* and an inner diameter 1023*b*. The upper portion 1021 has an inner surface 1021*c* with threads configured to threadably engage the outer surface 1013*c* of the lower portion 1013 of the top box 1010. The inner diameter 1021*b* may vary along the length of the upper portion 1021 to form an inner shelf 1025 that acts as a stop for the lower portion 1013 during threading engagement. The lower portion 1023 includes an outer surface 1023*c* with threads to threadably engage threads of a second pipe tubular (not shown).

The cylindrical magnet 1050 may be a high temperature magnet (retains magnetic properties up to about 1000 degrees F.) and has an outer diameter 1050*a* and an inner diameter 1050*b*. The outer diameter 1050*a* is less than the outer diameter 1011*a* (the largest outer diameter of the top box 1010) and less than the outer diameter 1023*a* (the largest outer diameter of the bottom pin 1020). The inner diameter 1050*b* is greater than the outer diameter 1012*a* such that the cylindrical magnet 1050 can slide along the outer surface of the middle portion 1012. With these dimensions, the cylindrical magnet 1050*b* has some freedom of movement to slide along the middle portion 1012 but is prevented from moving beyond the middle portion by the upper portion 1011 of the top box 1010 and the upper portion 1021 of the bottom pin 1020.

The outer diameter 1013*a* of the lower portion 1013 of the top box 1010 is greater than the inner diameter 1023*b* of the lower portion 1023 of the bottom pin 1020 such that a threaded engagement between the lower portion 1013 of the top box 1010 and the upper portion 1021 of the bottom pin 1020 is limited by the shelf 1025. However, for part of its length, the upper portion 1021 has an inner diameter substantially the same as the outer diameter 1013*a* so that there will be threaded engagement between the upper portion 1021 and the lower portion 1013. Thus, the top part of the upper portion 1021 allows engagement with the lower portion 1013 and the bottom part of the upper portion 1021 limits the degree of movement top box 1010 into the bottom pin 1020 and prevents the upper portion 1011 and the upper portion 1021 from applying compression force to the cylindrical magnet 1050. In some embodiments, and as shown in FIG. 10B, the upper portion 1021 may include a recession 1030 configured to receive an O-ring 1040.

In greater detail, FIG. 10C shows the O-ring 1040 provides a seal to prevent fluids from moving between the outer surface of the lower portion 1013 and the inner surface of the upper portion 1021. The O-ring 1040 provides an additional seal, when the outer surface of the lower portion 1013 compresses the O-ring 1040 against the inner surface of the upper portion 1021, to the seal already provide by the threaded connection between the lower portion 1013 and the upper portion 1021. In an alternative embodiment, the recession configured to receive the O-ring may be on the lower portion 1013 and form a seal when the O-ring is compressed by the inner wall of the upper portion 1021.

While the cylindrical magnet 1050 provides an uninterrupted field of magnetic flux to the fluid in the magnetic sub 900, the effectiveness of the magnetic field depends in part on the velocity at which the particles within the fluid are moving through the magnetic sub 900, and the magnetic sub 900 of FIGS. 10A-10B further provides the ability to accelerate the particles through the interior diameter of the sub assembly. Fluids passing through magnetic fields for the purpose of scale prevention must obtain a critical velocity of 7 feet per second or greater in order for proper ion alignment to occur. The velocity of the fluid may be lower than 7 feet per second while moving through the production tubing; however, in the magnetic field, the fluid must be moving at a velocity of at least 7 feet per second. Should the natural production velocity of the well be at a level less than 7 feet per second, then the magnetic sub 900 provides several mechanisms in which the interior fluid can be accelerated to accomplish this critical velocity.

The first mechanism in which to achieve this critical velocity would be to reduce the interior diameter of the sub assembly across the area of the magnetic field of flux. The sub assembly may have an interior constriction along the length of the cylindrical magnet, or at least part of the length of the magnet. This interior diameter reduction causes the fluid that is passing through the interior to be accelerated until the critical velocity is accomplished. In some embodiments, the critical velocity will be 7 feet/second. For those skilled in the art of production recovery of gas wells the velocity of the gas in the lower portion of the well bore is going to be lower than the velocity of the gas in the upper portion of the hole. This occurs due to the compressed state of the gas in the lower portion of the well bore. This gas compression in the lower portion of the well is due to the weight of the fluid and the gas in the upper portion of the well reacting on the gas in the lower portion there by compressing the deeper gas more. As the gas travels further up hole or out of the well the reactive load becomes less and the velocity increases proportionate to the load applied. Therefore it is understood by those skilled in the art of production recovery the gas in the lower portion of the wellbore will move the slowest. Under these conditions, only the interior diameter of the lower magnetic subs needs to be reduced to accelerate the fluid and gas mixture through the magnetic field.

A second mechanism, in addition to or instead of reducing the interior diameter of the sub assembly, includes a mandrel or rod being run and positioned across the sub assembly to reduce the interior diameter or cross section area of the sub through the magnetic field. In one embodiment, the sub assembly has a recess or profile incorporated into the assembly in which the rod or mandrel can be locked into preventing its movement. Thereby keeping it positioned across the magnetic field of flux. This mandrel or rod is designed as not to affect the flow of the oil and gas beyond accelerating its velocity. This embodiment allows larger diameter mandrels to be run as the wells pressurization and subsequent velocity diminishes as the well becomes older. These mandrels or rods are designed to be run on wireline or coiled tubing eliminating the need to extract the tubing to change the interior dimension of the magnetic sub assembly. For those skilled in the art of oil and gas well servicing the magnetic field generated by the assemblies can further be used as a magnetic marker to identify or isolate specific areas of the tubing. The magnetic signature of the assembly can be measured by instrumentation run on coiled tubing, wireline or electric line. This magnetic signature relative to the subs placement with in the tubing string provides an accurate indication of depth within the well. In yet another embodiment, radioactive isotopes can be incorporated into pockets in the sub assembly to accomplish the same effect.

Figure 11A:
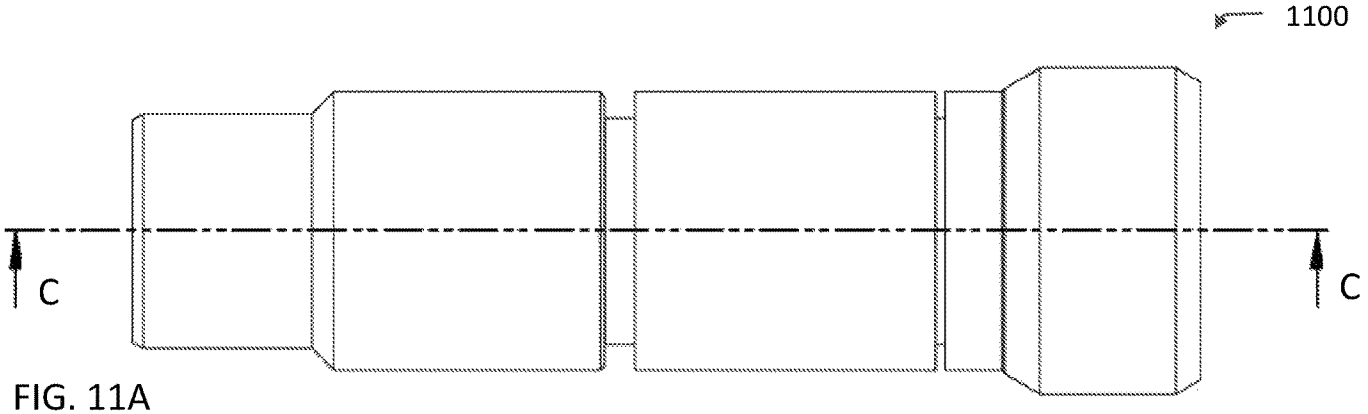
FIG. 11A shows a perspective view of an embodiment of the sub of FIG. 9 for mating hydrocarbon carrying conduits with different diameters.
Figure 11B:
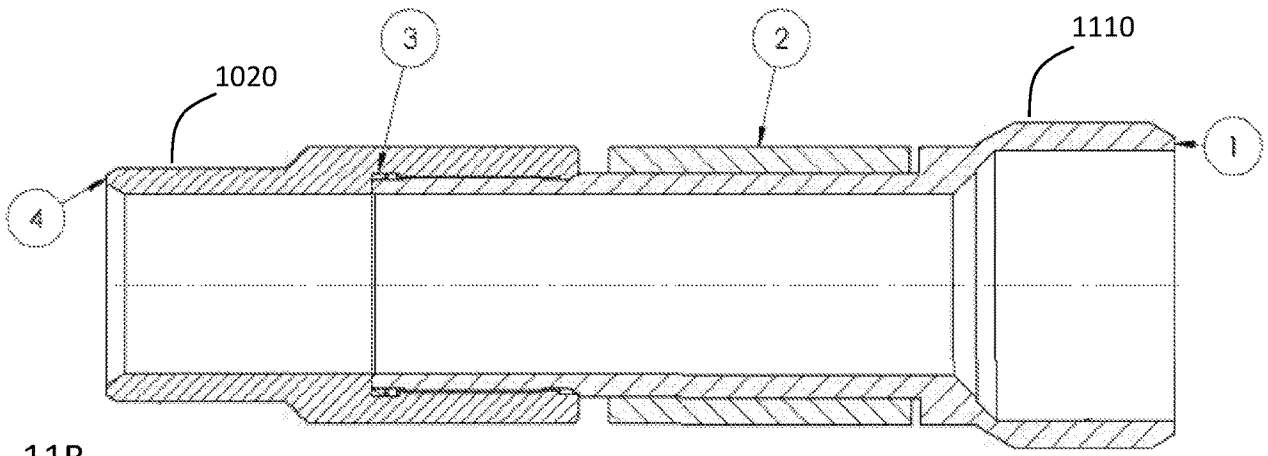
FIG. 11B shows a cross sectional view of the sub of FIG. 11A, taken along line C-C.

FIGS. 11A and 11B show a variation on the alternative embodiment of the magnetic sub of FIGS. 10A-10C. Here, the magnetic assembly 1100 is nearly identical to magnetic sub 900; however, the top box 1110 includes an upper portion 1110 configured to mate with a first production tubular that has different dimensions than a second production tubular that is to be mated to the lower portion 1020. Thus, while FIGS. 10A and 10B show an embodiment wherein the magnetic sub 900 is disposed between two tubulars with identical dimension, FIGS. 11A and 11B show the magnetic sub 1100, which is configured to be disposed between non-identical production tubulars. While FIGS. 11A and 11B shown the magnetic sub 1100 configured to receive a larger production tubular at the top box end 1110, a person of ordinary skill in the art would understand that the configuration could be reversed so that the top box end received a smaller tubular and the bottom pin end received a larger tubular.

In accordance with the apparatus and systems of the present disclosure, as well as the associated methods employing such apparatus and systems, at least one undesirable solid phase deposit can be controlled, minimized, or prevented using the magnetic systems described herein. As used herein, the term "solid phase deposit" refers broadly to those compounds or compositions which can form and deposit within a production casing, thereby decreasing the well production profile. These solid phase deposits include, but are not limited to, scale deposits, paraffin deposits, asphaltene deposits, hydrates, and combinations thereof.

Scale formation, as used herein, can generally be thought of as an adherent deposit of predominantly inorganic compounds. In this regard, a common process leading to scale formation in hydrocarbon production operations is the precipitation of sparingly soluble salts from oilfield brines. Some oilfield brines contain sufficient sulfate ion in the presence of barium, calcium, and/or strontium ions that the potential for forming barium sulfate ($BaSO_4$) and/or strontium sulfate ($SrSO_4$) scale exists. Often, the formation of scale results in reduced production and increased maintenance costs associated with the hydrocarbon production. Further, in some locations, naturally occurring radioactive materials have been found to incorporate themselves into the scale, resulting in health, safety, and liability concerns and increased scale disposal costs, in addition to the removal and/or inhibition of scale formation. Accordingly, scale deposits, as used herein, refer to those classes of compounds including but not limited to calcium carbonate ($CaCO_3$), calcium sulfate ($CaSO_4$), calcium sulfide ($CaS$), barium sulfate ($BaSO_4$), barium sulfide ($BaS$), barium thiosulfate ($BaS_2O_3$), strontium sulfate ($SrSO_4$), sodium carbonate ($Na_2CO_3$), sodium sulfate ($Na_2SO_4$), sodium sulfide ($Na_2S$), potassium carbonate ($K_2CO_3$), potassium sulfate ($K_2SO_4$), magnesium sulfate ($MgSO_4$), magnesium chloride ($MgCl_2$), halite ($NaCl$), zinc sulfide ($ZnS$), zinc sulfite ($ZnSO_3$), zinc sulfate ($ZnSO_4$), lead sulfide ($PbS$), lead sulfite ($PbSO_3$), lead sulfate ($PbSO_4$), and the like, as well as combinations thereof.

Asphaltenes are commonly defined as that portion of crude oil which is insoluble in heptane, are soluble in toluene, and typically exist in the form of colloidal dispersions stabilized by other components in the crude oil. Asphaltenes are often brown to black amorphous solids with complex structures, involving carbon, hydrogen, nitrogen, and sulfur. Asphaltenes are typically the most polar fraction of crude oil, and will often precipitate out upon pressure, temperature, and compositional changes in the oil resulting from blending or other mechanical or physicochemical processing. Asphaltene precipitation can occur in pipelines, separators, and other equipment, as well as downhole and in the subterranean hydrocarbon-bearing formation itself. Once deposited, these asphaltenes generally present numerous problems for hydrocarbon producers, such as plugging downhole tubulars and/or wellbores, choking off pipes, and interfering with the functioning of separator equipment, all of which compound the production costs and require the need for remediation. Asphaltene, as used herein, includes the non-volatile and polar fractions of petroleum that are substantially insoluble in n-alkanes (such as pentane or hexane), as defined and described by Diallo, et al. ["Thermodynamic Properties of Asphaltene: A Predictive Approach Based on Computer Assisted Structure Elucidation and Atomistic Simulations", in Asphaltene and Asphalts.2. Developments in Petroleum Science, 40 B.; Yen, T. F. and Chilingarian, G. V., eds.: Elsevier Science B. V.: pp. 103-127 (2000)].

Natural gas hydrates, or simply hydrates, as described herein, comprise "cages" of water molecules enclosing "guest" molecules of natural gas, which occurs with sufficient combinations of temperature and pressure. Typical hydrate guest molecules include methane, ethane, propane, light hydrocarbons, methane-to-heptanes, nitrogen, hydrogen sulfide ($H_2S$), and carbon dioxide ($CO_2$). Natural gas hydrates can form during the production, gathering, and transportation of hydrocarbons in the presence of water at high pressures and low temperatures. Depending on the pressure and gas composition, gas hydrates can build up at any place where water coexists with natural gas at temperatures as high as 80 degrees F. (about 30 degrees C.). Once formed, hydrates can deposit in the tubing, flowlines, and/or process equipment, thus restricting flow. In many cases, these restrictions eventually form plugs. Gas transmission lines and new gas wells are especially vulnerable to being at least partially blocked by hydrates. Hydrate plugs represent safety hazards as they contain significant volumes of compressed natural gas and have been known to break free as projectiles in pipelines, causing several pipeline ruptures. As such, many in the industry feel it prudent to prevent hydrate plugs whenever possible, rather than trying to remediate them once they form.

The phenomenon of paraffin or wax deposit formation is common in petroleum industry, and it occurs consequent to modifications in the thermodynamics variables that change the solubility of wax or paraffin fractions present in petroleum. The paraffining phenomenon involves specially saturated hydrocarbons of linear chain and high molecular weight during production, flow and treatment of petroleum. The deposition in subsea lines, surface equipment, production column, or even in reservoir rock can cause significant and crescent loss of petroleum production. Typically, paraffin deposits on the wall of downhole tubulars and other, similar places downhole such as near entrances and exits of chokes, and along collars and similar restriction devices in the flow path of the produced petroleum.

Precipitation and deposition of wax are associated to phase equilibrium of hydrocarbons and to fluid-dynamics conditions of flow, respectively. The paraffining becomes one function of petroleum intrinsic characteristics and temperature, velocity and pressure variations during the production. The appearance of a solid phase in petroleum and the subsequent wax deposition are related to changes in the phase equilibrium, caused by petroleum cooling and/or separation of lighter fractions, originally dissolved in petroleum. As used herein, paraffin or wax refers to non-aromatic saturated hydrocarbons, or a mixture thereof, having the general chemical formula $C_nH_{2n+2}$, wherein n is an integer between and including 22 and 27.

The general methods of use of several of the assemblies and systems described herein are now described. Prior to selecting a magnetic system, typically one must first determine the fluid flow rate through the hydrocarbon conduit, and using this information further determine what system is needed, and the relative placement of such systems within the conduit. Information needed to calculate hydrocarbon flow rate through a conduit (tubing) includes one or more of the following: oil or gas condensate; reservoir pressure (psi); bottom hole temperature; water-to-liquid ratio; Formation Gas Specific (typically about 1.01); tubing inside diameter and outside diameter, and/or the tubing type and tubing weight; depth of the production tubing; casing inner diameter (i.d.) and depth; type of threaded connections used in the tubing string; and, tested gross liquid rate.

In the instance that tubing has not yet been run downhole, an original magnetic assembly system, such as the magnetic assemblies 10, 900, 1100, may be chosen and put together (that is, the desired magnet, seals, and lock nut are installed on the assembly), and this is threadably attached to the end of the first tubing to be placed in the well. The first tubing of the tubing string is then run downhole, and consecutive tubings are attached and run downhole, with a plurality of magnetic assemblies 10 (or 900 or 1100) being positioned between about 250 ft, until the entire length of production tubing has been placed. At the surface, the tubing below the magnetic assembly is laid on the drill floor, and the assembly is hand-threaded into the box connection. The next tubular pin end is threadably attached into the box connection of the assembly, and the "make-and-break" device is connected onto the tubular above and below the assembly. The desired torque is then applied, and the double tubular is picked up and connected to the tubing string being inserted into the wellbore.

While the various embodiments of the present invention disclosed herein have been made in the context of downhole hydrocarbon well production tubing, it will be appreciated that the inventive concepts taught herein have application to all types of surface and downhole equipment that experience deposit buildup. Moreover, the application of these inventions is not limited to the oil and gas industry, but may be implemented anywhere deposits build up, such as in water lines where scale is often an issue.

All of the methods, processes, and/or apparatus disclosed and claimed herein can be made and executed without undue experimentation in light of the present disclosure. While the methods and apparatus of this invention have been described in terms of preferred embodiments, it will be apparent to those of skill in the art that variations may be applied to the methods, processes and/or apparatus and in the steps or in the sequence of steps of the methods described herein without departing from the concept and scope of the invention. More specifically, it will be apparent that certain features which are both mechanically and functionally related can be substituted for the features described herein while the same or similar results would be achieved. All such similar substitutes and modifications apparent to those skilled in the art are deemed to be within the scope and concept of the invention.

While embodiments in the present disclosure have been described in some detail, according to the preferred embodiments illustrated above, it is not meant to be limiting to modifications such as would be obvious to those skilled in the art.

The foregoing disclosure and description of the disclosure are illustrative and explanatory thereof, and various changes in the details of the illustrated apparatus and system, and the construction and the method of operation may be made without departing from the spirit of the disclosure.

What is claimed is:

1. An apparatus for magnetically treating fluids flowing through a conduit to inhibit the formation and/or deposition of solid phase deposits within the conduit, the apparatus comprising:

a tubular box member configured to be interconnected with a first conduit in an axial manner, the tubular box member comprising:

a first tubular box portion with a first tubular box outer diameter;

a second tubular box portion with a second tubular box outer diameter; and a third tubular box portion with a third tubular box outer diameter, wherein the second tubular box portion is disposed between the first tubular box portion and the third tubular box portion;

a tubular pin member comprising:

a first tubular pin portion with a first tubular pin portion outer diameter and a first tubular pin portion inner diameter; and a second tubular pin portion with a second tubular pin portion inner diameter;

wherein the first tubular pin portion is configured to be interconnected with the third tubular box portion in an axial manner, and wherein the second tubular pin portion is configured to be interconnected with a second conduit in an axial manner, and wherein the second conduit is located below the first conduit in the subterranean well bore;

a cylindrical magnet having a North magnetic pole, a South magnetic pole, a magnet outer diameter, and a magnet inner diameter and disposed around at least part of the second tubular box portion; and wherein the first tubular box portion outer diameter is greater than the cylindrical magnet outer diameter; the second tubular box portion outer diameter is equal to or smaller than the cylindrical magnet inner diameter; the third tubular box portion outer diameter is smaller than the first tubular pin portion inner diameter; the first tubular pin portion outer diameter is greater than the magnet outer diameter; and the first tubular pin inner portion diameter is smaller than the third tubular box portion outer diameter.

2. The apparatus of claim 1, further comprising:

an elastomeric O-ring disposed between the third tubular box portion and the first tubular pin portion.

3. The apparatus of claim 1, wherein the cylindrical magnet is oriented such that the North Pole of the magnet is oriented towards the first tubular box portion and the South pole of the magnet is oriented towards the first tubular pin portion.

4. The apparatus of claim 1, wherein the cylindrical magnet is a rare earth magnet.

5. The apparatus of claim 1, wherein the cylindrical magnet is loosely disposed about the at least part of the second tubular box portion.

6. A system for reducing buildup in a hydrocarbon flow path located in a subterranean well, comprising:

a plurality of magnetic subs disposed between hydrocarbon conduits at regular intervals in a subterranean well bore, wherein each of the magnetic subs comprises:

a tubular box member configured to be interconnected with a first conduit in an axial manner, the tubular box member comprising:

a first tubular box portion with a first tubular box outer diameter;

a second tubular box portion with a second tubular box outer diameter; and a third tubular box portion with a third tubular box outer diameter, wherein the second tubular box portion is disposed between the first tubular box portion and the third tubular box portion;

a tubular pin member comprising:

a first tubular pin portion with a first tubular pin portion outer diameter and a first tubular pin portion inner diameter; and a second tubular pin portion with a second tubular pin portion inner diameter;

wherein the first tubular pin portion is configured to be interconnected with the third tubular box portion in an axial manner, and wherein the second tubular pin portion is configured to be interconnected with a second conduit in an axial manner, and wherein the second conduit is located below the first conduit in the subterranean well bore;

a cylindrical magnet having a North magnetic pole, a South magnetic pole, a magnet outer diameter, and a magnet inner diameter and disposed around at least part of the second tubular box portion; and wherein the first tubular box portion outer diameter is greater than the cylindrical magnet outer diameter; the second tubular box portion outer diameter is equal to or smaller than the cylindrical magnet inner diameter; the third tubular box portion outer diameter is smaller than the first tubular pin portion inner diameter; the first tubular pin portion outer diameter is greater than the magnet outer diameter; and the first tubular pin inner portion diameter is smaller than the third tubular box portion outer diameter.

7. The system of claim 6, wherein the magnet is loosely disposed about the outside surface.

8. The system of claim 6, wherein the magnet comprises a rare earth magnet.

9. The system of claim 8, wherein the rare earth magnet is a samarium cobalt magnet.

10. The system of claim 6, further comprising:

a shield disposed about the outer surface of at least one of the magnets and adapted to protect the at least one of the magnets while it is located in the subterranean well, the shield having an outer diameter.

11. The system of claim 10, wherein the shield has an outer diameter that is equal to or less than the larger of the diameters of the tubular box member and the tubular pin member.

12. The system of claim 6, wherein the regular intervals have a size of 250 feet or less.

13. The system of claim 12, wherein the regular intervals have a size of 165 feet or less.

14. The system of claim 6, wherein all of the hydrocarbon conduits are uniform in outer and inner diameter.

15. The system of claim 6, wherein at least one of the hydrocarbon conduits connected to one side of one of the magnetic subs has a different tubular dimension than at least one other of the plurality of tubulars connected to another side of the one of the magnetic subs.

16. A process for removing or inhibiting the formation of solid phase deposits from hydrocarbons, the process comprising:

connecting an apparatus according to claim 1 to an end of a first conduit, running the first conduit and associated system in a subterranean well;

connecting and running additional conduits and apparatuses so as to have at least a plurality of apparatuses longitudinally spaced apart from one another in the wellbore; and flowing a hydrocarbon-bearing fluid through the apparatuses, whereby solid phase deposits are removed or inhibited by the apparatuses.

17. The process of claim 16, wherein the solid phase deposits removed or inhibited are scale deposits, paraffin deposits, hydrate deposits, asphaltene deposits, or combinations thereof.

18. An oil or gas production process, comprising:

establishing a hydrocarbon flow path in a subterranean well, the flow path comprising an inner surface and an outer surface and adapted to flow a hydrocarbon-bearing fluid from a distal end to a proximal end;

providing a substantially cylindrical permanent magnet adjacent the outside surface such that a North magnetic pole is adjacent the distal end and a South magnetic pole is adjacent the proximal end, the magnet having an outer surface and first and second axially spaced ends;

limiting movement of a top box and bottom pin combination configured to threadingly engage one another, wherein the magnet is disposed around a portion of the top box, and the bottom pin comprises a shelf stop to limit the threading engagement between the top box and the bottom pin before the magnet is longitudinally compressed by the top box and bottom pin; and providing a first conduit portion located adjacent the first axially spaced end of the magnet;

providing a second conduit portion adjacent the second axially spaced end of the magnet; and resulting in an outer diameter of the first and second conduit portions that is equal to or greater than the outer diameter of a shield axially surrounding the magnet.

* * * * *